US005122642A

United States Patent [19]

Herrmann

[11] Patent Number: 5,122,642

[45] Date of Patent: Jun. 16, 1992

[54] RESET DEVICE FOR THE DIGIT ROLLERS OF A COUNTER

[75] Inventor: Werner Herrmann, Frankfurt, Fed. Rep. of Germany

[73] Assignee: VDO Adolf Schindling AG, Frankfurt am Main, Fed. Rep. of Germany

[21] Appl. No.: 647,138

[22] Filed: Jan. 29, 1991

[30] Foreign Application Priority Data

Feb. 15, 1990 [DE] Fed. Rep. of Germany ..... 4004585

[51] Int. Cl.[5] ..... G06C 15/42

[52] U.S. Cl. ..... 235/144 SP; 235/131 JA; 235/131 FD; 235/139 R; 235/139 A

[58] Field of Search ..... 235/135, 139 R, 139 A, 235/131 JA, 131 FD, 144 B, 144 SP

[56] References Cited

U.S. PATENT DOCUMENTS

| | | | |
|---|---|---|---|
| 2,628,779 | 2/1953 | Bliss | 235/139 A |
| 2,658,685 | 11/1963 | Harada | 235/139 A |
| 3,578,792 | 5/1971 | Affel | 235/144 SP |
| 4,019,031 | 4/1977 | Young | 235/131 FD |
| 4,028,530 | 6/1977 | Bud et al. | 235/144 SP |
| 4,096,377 | 6/1978 | Prentice et al. | 235/139 R |
| 4,829,164 | 5/1989 | Rudolph et al. | 235/139 R |
| 4,970,377 | 11/1990 | Corcoran | 235/144 Sp |
| 4,970,378 | 11/1990 | Bleicher | 235/131 JA |

*Primary Examiner*—John S. Heyman
*Attorney, Agent, or Firm*—Martin A. Farber

[57] ABSTRACT

A reset device (7) for the digit rollers (3) of a counter has a positioning spring (22) developed integrally on a shift drive bridge (9), the positioning spring being adapted to engage by means of a detent projection (21) into detent recesses (17–20) of the side surfaces (13–16) of a position setter (12). In this way, the position setter (12) passes in particularly reliable manner into each of its four possible positions.

7 Claims, 3 Drawing Sheets

RESET DEVICE FOR THE DIGIT ROLLERS OF A COUNTER

FIELD AND BACKGROUND OF THE INVENTION

The present invention relates to a reset device for the digit rollers of a counter, which has a swingable shift drive bridge supporting shift pinions for the digit rollers and having a reset comb which is moveable against cardioids of the digit rollers. Each of the shift pinions has a position setter formed by a multi-edge the outer periphery of which is formed, as in the case of a screw head, by flat adjoining side surfaces. A positioning spring rests with initial tension against one of the side surfaces or does so only in the zero position so that a shift pinion is held by the positioning spring in fixed positions corresponding to the ten positions of each of the digit rollers. Such reset devices are provided on the trip odometers of modern automotive vehicles and are therefore well known.

Upon the actuation of the reset device, the shift pinions must first of all be brought out of engagement with the teeth of the digit rollers. The individual teeth of the reset comb then come against the corresponding cardioids of the individual digit rollers and reset them to zero. If the actuating button for the reset device is then released, the shift pinions swing back and pass again into engagement with the digit rollers. In this connection, with the known reset devices, it may happen in unfavorable positions that a tooth of one shift pinion comes precisely against a tooth of the associated digit roller because the position setter, instead of turning into a stable position, happens to remain stationary in an intermediate position in which one edge of it rests against the positioning spring. Upon engagement into the toothing of the digit roller the shift pinion then jumps into one of the two adjacent stable positions and thus leads to a turning of the digit roller away from the zero reset position.

SUMMARY OF THE INVENTION

It is an object of the invention so to develop a reset device of the aforementioned type that, with its shift pinion, the danger of assuming an unstable intermediate position is as small as possible.

According to the invention, each of the side surfaces (13–16) has a central detent recess (17–20) into which a corresponding detent projection (21) of the positioning spring (22) engages into the desired positions of the position setter (12).

By these detent recesses and the detent projection on the positioning spring, the result is obtained that the intermediate positions of the position setter, in which the latter rests with one edge against the positioning spring, are so unstable that, in practice, the position setter will always swing into a stable position. As a result, upon reengagement into the digit rollers, the shift pinions engage there in each case in precisely aligned positions so that the digit rollers retain their exact zero position. This manner of operation, which is improved as compared with the previously known reset devices, is obtained at extremely little expense so that the reset device of the invention can be produced at only insignificantly greater expense than comparable reset devices.

Remaining in a labile intermediate position is excluded in particularly dependable fashion if, in accordance with one advantageous feature of the invention, the detent recesses (17–20), and accordingly also the detent projections (21), are triangular in cross section as seen from the side.

For trip odometers of automotive vehicles it is advantageous if the position setter (12) is of square development as seen from the side. It then has four stable positions with which the 10 necessary positions of the associated digit rollers can be optimally reached in the manner that each shift pinion is imparted eight teeth and each digit roller 20 teeth. Rotation of a shift pinion by two teeth then leads to a change from one stable position into the next following stable position and thus to a rotation of the digit roller by one position.

The reset device can be manufactured in particularly cost-favorable manner if the shift drive bridge (9) consists of plastic and the positioning spring (22) is formed by an arm of the shift drive bridge (9).

In order further to reduce the cost of manufacture, a setting spring (23) which urges the shift drive bridge (9) into a basic position can be formed on the shift drive bridge (9).

The shift drive bridge can be held with one end side against the stop without the use of a separate spring if a spring tongue (24) which urges the shift drive bridge (9) in mounted condition towards the opposite end side is arranged on one end side of the shift drive bridge (9).

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Figure 1:
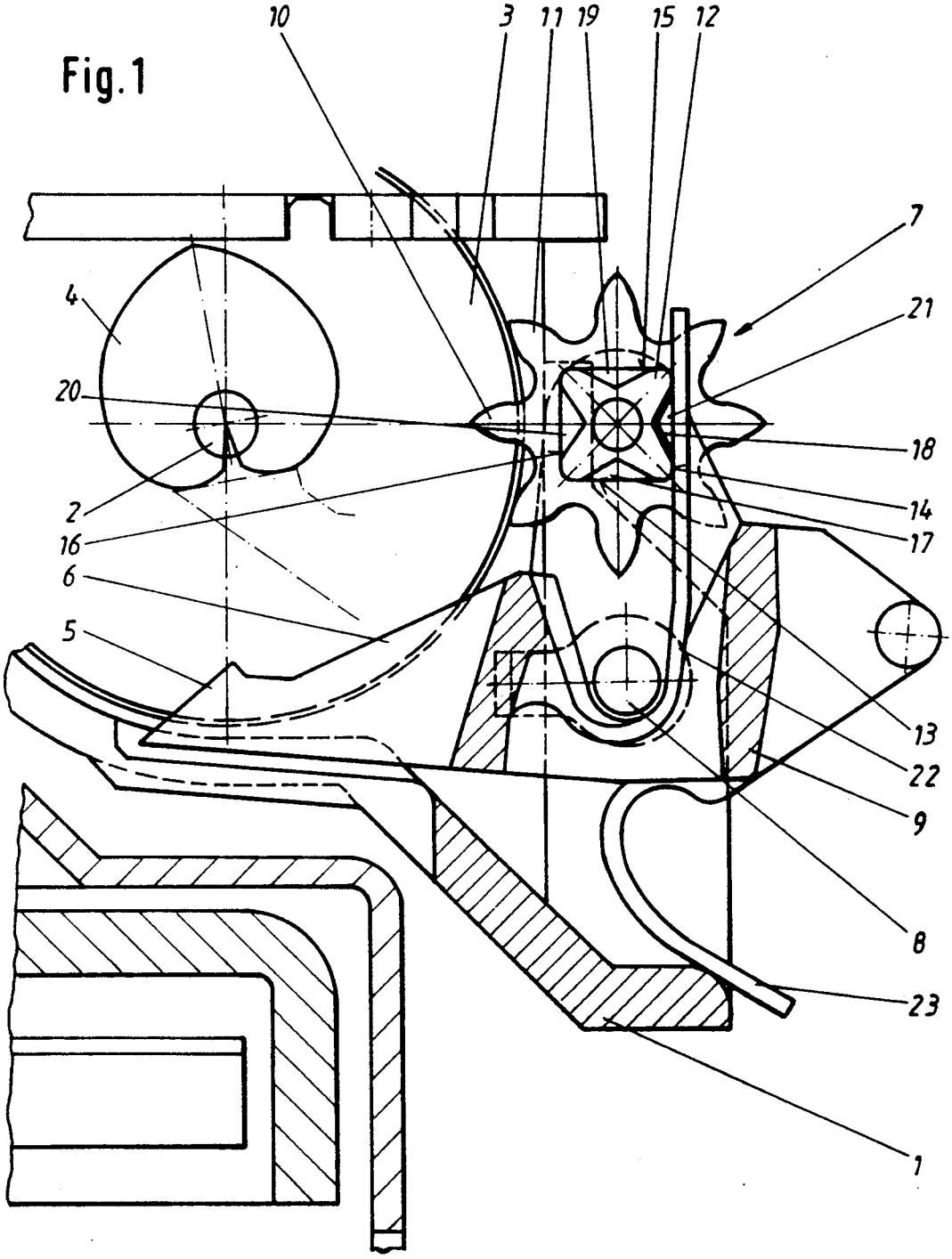
FIG. 1 is a cross section through the reset device of the invention together with adjoining parts, the view being taken in a generally downward direction of the bridge as presented in FIG. 2.

FIG. 1 shows in part a housing 1 in which digit rollers 3 are mounted for rotation alongside each other around a roller shaft 2. For the resetting of the digit rollers 3 to zero, each digit roller 3 has a cardioid 4 against which a reset tooth 5 of a reset comb 6 can be swung. The reset comb 6 is part of a reset device 7 which has a shift drive bridge 9 which is swingable around a shaft 8. Within this shift drive bridge 9 there is mounted one shift pinion 10 for each digit roller 3, the shift pinion engaging in the basic position shown with teeth 11 in a toothing (not shown) of the digit roller 3.

On one end surface of the shift pinion 10 a position setter 12 is arranged fixed for rotation, it having an approximately square cross section as seen from the side and having a detent recess 17, 18, 19, 20 in each of its four side surfaces 13, 14, 15, 16, each detent recess having a triangular cross section as seen from the side. Into the detent recess 18 facing away from the digit roller 3, there engages a detent projection 21 of a positioning spring 22 which is integral with the shift drive bridge.

On its lower side as seen in FIG. 1, the shift drive bridge 9 has a setting spring 23 which rests against the housing 1 and urges the shift drive bridge 9 in counter-clockwise direction. As a result, the shift pinions 10 engage into the teeth (not shown) of the digit rollers 3, so that the latter are driven. If the shift drive bridge 9 is swung in clockwise direction, then the shift pinions 10 come out of engagement and the reset teeth 5 set the digit rollers 3 back into the zero position.

Figure 2:
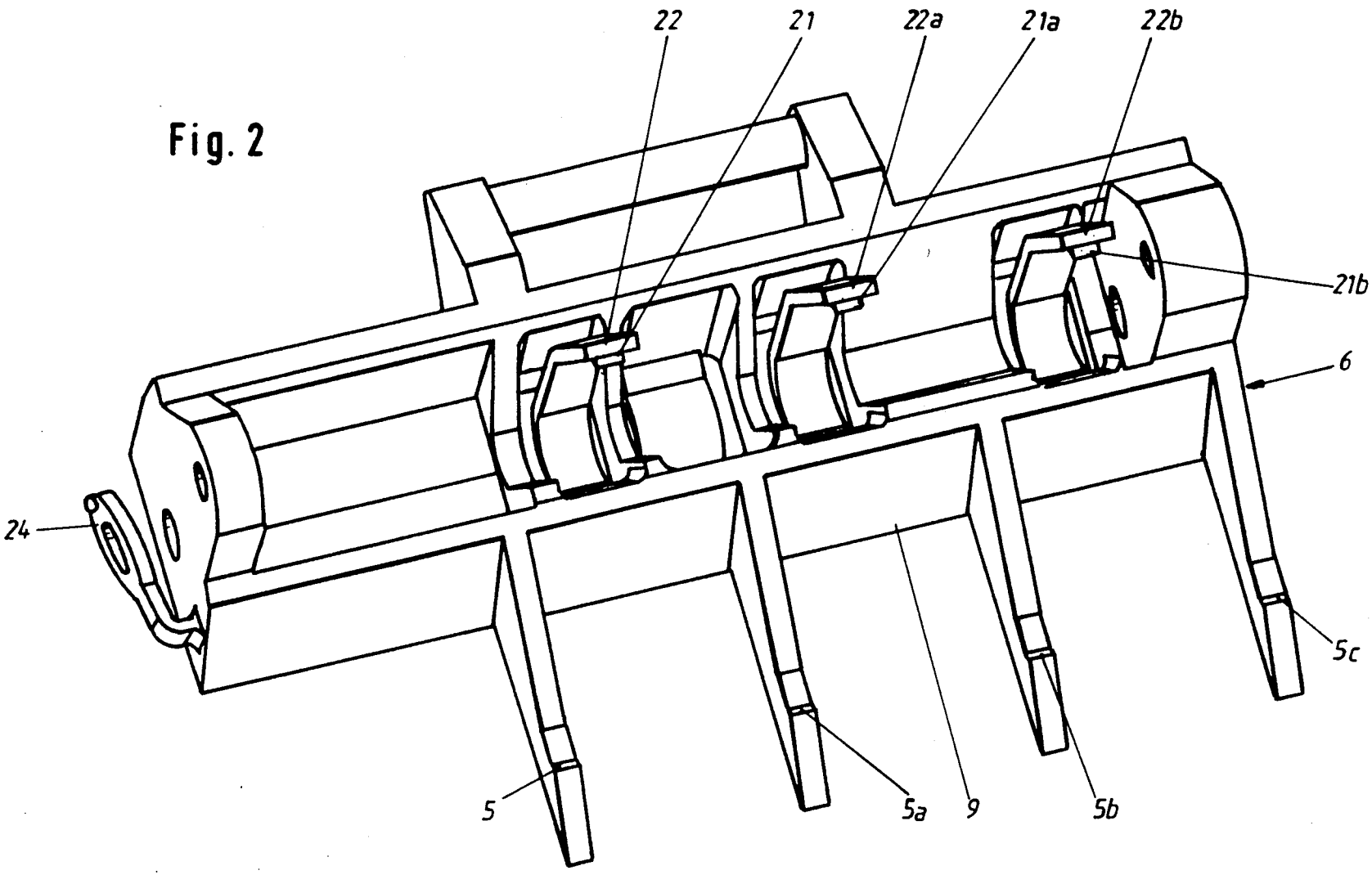
FIG. 2 is a perspective view of a shift drive bridge of the reset device.

FIG. 2 shows the form of the shift drive bridge 9. There can be noted four reset teeth 5, 5*a*, 5*b*, 5*c* of the reset comb 6 and three positioning springs 22, 22*a*, 22*b* each having the detent projection 21, 21*a*, 21*b* respectively. FIG. 2 furthermore shows on the left end side of the shift drive bridge 9, a spring tongue 24 which is developed integral with it and can rest in mounted condition of the shift drive bridge 9 against the housing 1 and thereby urges the shift drive bridge 9 towards the opposite end side.

Figure 3:
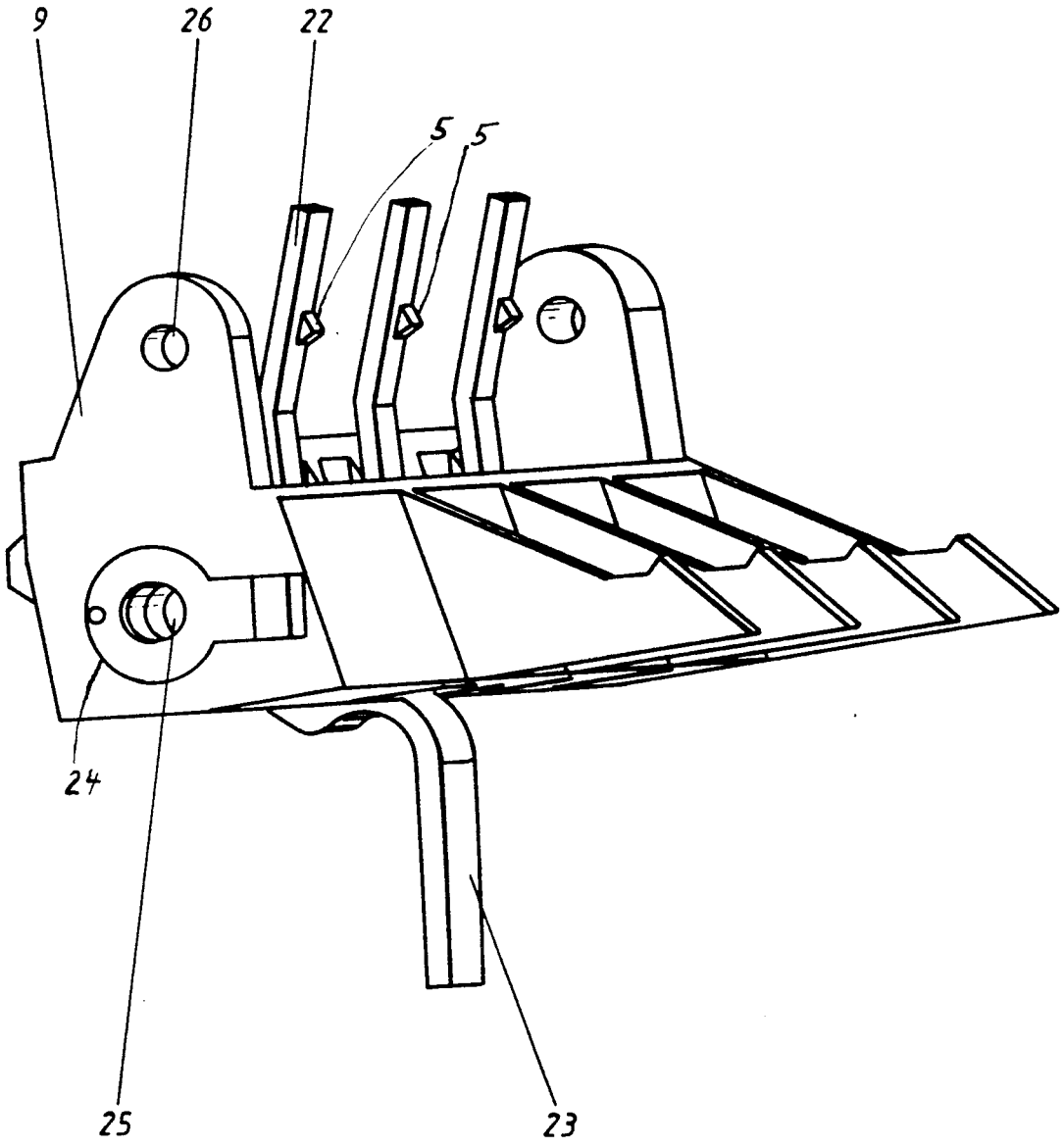
FIG. 3 shows the shift drive bridge of FIG. 2 in perspective, in a position which is turned with respect to FIG. 2.

FIG. 3 shows, in addition to the positioning springs 22, the reset teeth 5 and the spring tongue 24 of the shift drive bridge 9, also the setting spring 23 with which the shift drive bridge 9 rests against the housing 1. Furthermore. two holes 25, 26 have been positioned in FIG. 3. The upper hole 26 serves to receive a shaft (not shown) on which the shift pinions 10 are mounted, while the lower hole 25 serves to mount the shift drive bridge 9 on the shaft 8 of the housing which is shown in FIG. 1.

I claim:

1. A reset device for the digit rollers of a counter, the counter having shift pinions for driving the digit rollers, the reset device comprising:

a swingable shift drive bridge supporting the shift pinions for the digit rollers;

cardioid-shaped elements connected to respective ones of the digit rollers;

a reset comb connected rigidly to the bridge for movement against the cardioid-shaped elements of the digit rollers;

a plurality of position setters disposed in respective ones of said shift pinions, each position setter being formed with a multi-edge, the outer periphery including generally flat adjoining side surfaces;

a plurality of positioning springs wherein respective ones of said positioning springs rest with initial tension against respective ones of said position setters for engagement with one of the side surfaces of respective ones of said position setters in a zero position, thereby to hold the shift pinions in fixed positions corresponding to predetermined positions of the digit rollers, each of the side surfaces of the respective position setters having a central detent recess; and a set of detent projections carried by the shift drive bridge, said set of positioning springs connecting between the bridge and respective ones of the detent projections for urging corresponding detent projections into respective ones of the detent recesses to establish desired positions of the position setter.

2. A reset device according to claim 1, wherein said detent recesses and said detent projections are triangular in cross section as viewed along an axis of rotation of a position setter.

3. A reset device according to claim 2, wherein the position setter has a square format as viewed along the axis of rotation of the position setter.

4. A reset device according to claim 1, wherein the position setter has a square format as viewed along an axis of rotation of the position setter.

5. A reset device according to claim 1, wherein the shift drive bridge is made of plastic and each of the positioning springs is constructed as an arm of the shift drive bridge.

6. A reset device according to claim 1, further comprising a housing and a setting spring which is located between the housing and the shift drive bridge and urges the shift drive bridge into a basic position, the setting spring being formed on the shift drive bridge.

7. A reset device according to claim 1, further comprising a spring tongue which is disposed on a first end of the shift drive bridge and urges the shift drive bridge in a direction towards a second end opposite said first end of the shift drive bridge.

* * * * *